US010311801B2

(12) United States Patent
Otoi

(10) Patent No.: US 10,311,801 B2
(45) Date of Patent: Jun. 4, 2019

(54) LIQUID CRYSTAL DISPLAY DEVICE

(71) Applicant: Sharp Kabushiki Kaisha, Osaka-shi, Osaka (JP)

(72) Inventor: Katsuya Otoi, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 378 days.

(21) Appl. No.: 14/654,940

(22) PCT Filed: Dec. 19, 2013

(86) PCT No.: PCT/JP2013/084072

§ 371 (c)(1),
(2) Date: Jun. 23, 2015

(87) PCT Pub. No.: WO2014/115449

PCT Pub. Date: Jul. 31, 2014

(65) Prior Publication Data

US 2015/0348469 A1 Dec. 3, 2015

(30) Foreign Application Priority Data

Jan. 22, 2013 (JP) ..... 2013-009551

(51) Int. Cl.
*G09G 3/34* (2006.01)
*G09G 3/36* (2006.01)

(52) U.S. Cl.
CPC ..... *G09G 3/3406* (2013.01); *G09G 3/3426* (2013.01); *G09G 3/36* (2013.01); *G09G 2320/0238* (2013.01); *G09G 2320/0626* (2013.01); *G09G 2320/0646* (2013.01); *G09G 2360/145* (2013.01); *G09G 2360/16* (2013.01)

(58) Field of Classification Search
None
See application file for complete search history.

(56) References Cited

U.S. PATENT DOCUMENTS

2007/0047019 A1* 3/2007 Toyoda ..... H04N 1/40068 358/448
2009/0184915 A1* 7/2009 Tsai ..... G09G 3/3406 345/102
2011/0037784 A1 2/2011 Shiomi
2011/0037785 A1* 2/2011 Shiomi ..... G09G 3/3426 345/690
2015/0049132 A1* 2/2015 Johnson ..... G06T 5/009 345/690

FOREIGN PATENT DOCUMENTS

WO 2009/157221 A1 12/2009

* cited by examiner

*Primary Examiner* — Temesghen Ghebretinsae
*Assistant Examiner* — Paras D Karki
(74) *Attorney, Agent, or Firm* — Keating & Bennett, LLP

(57) ABSTRACT

It is possible to realize a liquid crystal display device 1 which is provided with a down-converter 7, a local dimming control circuit 8, and an upscaling control circuit 9 including a luminance ratio calculation circuit and a gradation conversion circuit, and thus, capable of processing an image having an image size that is not assumed, and further, reducing a storage area, a processing load and a circuit size.

4 Claims, 13 Drawing Sheets

LIQUID CRYSTAL DISPLAY DEVICE

TECHNICAL FIELD

The present invention relates to a liquid crystal display device which performs a display using local dimming.

BACKGROUND ART

In recent years, a liquid crystal display device has been generally used which is capable of realizing a high image quality thereby performing display using a local dimming technique.

FIG. 10 is a diagram illustrating a function of a local dimming control circuit provided with a liquid crystal display device.

As illustrated in the drawing, full HD image data (image data of a 2K1K size) is input to a local dimming control circuit 50, and backlight luminance data, which is the luminance data of each area in the backlight is calculated in the local dimming control circuit 50, and is output to a backlight driving circuit 51. In addition, in the local dimming control circuit 50, gradation data of each pixel for the full HD (2K1K size) is calculated using the backlight luminance data and the above-described full HD image data, and is output to a liquid crystal driving circuit 52.

In other words, the local dimming control circuit 50 is configured to determine the gradation data of each pixel by adding the backlight luminance data.

There is no particular problem in a case where the image data of the 2K1K size as the image size that may be processed is input to the local dimming control circuit 50 in which the image size that may be processed is fixed to the 2K1K size.

Incidentally, the image data of the 2K1K size is image data of approximately horizontal 2000 pixels×vertical 1000 pixels. Specifically, a representative example is image data of 1920×1080.

However, in a case where, for example, UHD image data (image data of a 4K2K size) as an image size that is not assumed is input to the local dimming control circuit 50 in which the image size that may be processed is fixed to the 2K1K size, there is a need for providing an additional processing circuit (a backlight luminance distribution estimation circuit, a liquid crystal luminance calculation circuit or the like) to the outside in order to perform the process, calculate the gradation data of each pixel for the UHD (4K2K size) and output the gradation data to the liquid crystal driving circuit, which causes complexity in the process and increase in the process time and cost.

Incidentally, the image data of the 4K2K size is image data of approximately horizontal 4000 pixels×vertical 2000 pixels. Specifically, a representative example is image data of 3840×2160 dots, 4096×2160 dots, 4096×1776 dots, 3300×2160 dots and the like.

FIG. 11 is a diagram illustrating a circuit configuration of the related art provided with the local dimming control circuit 50, which may process the UHD image data (the image data of the 4K2K size) as the image size that is not assumed and in which the image size that may be processed is fixed to the 2K1K size.

As described above, the local dimming control circuit 50 is configured to calculate the gradation data of each pixel using the backlight luminance data and the full HD image data. Meanwhile, the backlight luminance data is also required for each pixel unit in terms of granularity, and a memory is required for storing each data, but in general, the image size that may be processed is fixed in the specification so as to reduce the cost.

As illustrated in FIG. 11, in a case where the image data of the 4K2K size is processed using the local dimming control circuit 50 in which the image size that may be processed is fixed to the 2K1K size, first, the image data of the 4K2K size is input to a down-converter 53 and converted to image data of the 2K1K size.

Further, the image data of the 2K1K size converted by the down-converter 53 is input to the local dimming control circuit 50, the luminance data (a control block size of the local dimming) of each area of the backlight and the gradation data (2K1K size) of each pixel are calculated in the local dimming control circuit 50, and the unnecessary gradation data (2K1K size) of each pixel is discarded without being used.

Incidentally, the backlight luminance data is output in the block size of the backlight (for example, in a case where the division number is horizontally 24 divisions and vertically 12 divisions, the data size of 24×12 blocks) and is supplied to the backlight driving circuit 51, and is also supplied to a backlight luminance distribution estimation circuit 54.

In the backlight luminance distribution estimation circuit 54, the backlight luminance data of the block size is converted to the backlight luminance distribution data (4K2K size) by estimation of luminance distribution (superimposing the luminance distribution on the entire block in accordance with the luminance distribution of each block using the input backlight luminance data of the block size and backlight illumination distribution of one block that is measured or estimated in advance), and the backlight luminance distribution data is supplied to a liquid crystal gradation calculation circuit 55.

Then, the liquid crystal gradation calculation circuit 55 calculates the gradation data (4K2K size) of each pixel based on the image data of the 4K2K size input to the down-converter 53 and the backlight luminance distribution data (4K2K size) to be supplied from the backlight luminance distribution estimation circuit 54, and the gradation data is supplied to the liquid crystal driving circuit 56.

FIG. 12 is a diagram specifically illustrating a process performed by the local dimming control circuit 50, the down-converter 53, the backlight luminance distribution estimation circuit 54 and the liquid crystal gradation calculation circuit 55 illustrated in FIG. 11.

Hereinafter, a description will be made regarding a method of the related art in which the liquid crystal gradation data of the 4K2K size is obtained from the input image data of the 4K2K size with reference to FIG. 12.

First, the input image data of the 4K2K size is reduced into reduced image data for local dimming (2K1K size) by the down-converter 53.

Incidentally, a method that is generally known may be employed as a reduction method, and any method of a nearest neighbor method, a linear interpolation method, quadratic interpolation, cubic interpolation, an average pixel method, and the like may be employed. It is possible to obtain a reduced result $V_{I1}$ by any one of the above-described methods (for example, the linear interpolation method) from 4K2K-size input image data $V_{i1}$ to $V_{i4}$, and it is possible to obtain a reduced result $V_{I2}$ from 4K2K-size input image data $V_{i5}$ to $V_{i8}$ in the same manner.

As described above, it is configured to obtain one reduced image data for the local dimming by reducing pixel data having an aspect ratio of 2×2 of the 4K2K-size input image data.

Then, reduced image data for the local dimming $V_{I1}$, $V_{I2}$ and so on are processed by the local dimming control circuit 50, and backlight luminance data $V_{B1}$, $V_{B2}$ and so on are output.

Then, 4K2K-size backlight luminance distribution data $V_{d1}, V_{d2}, \ldots, V_{d8}$ and so on are obtained by the backlight luminance distribution estimation circuit 54 from the illumination distribution of one block obtained from the backlight luminance data $V_{B1}$, $V_{B2}$ and so on, which are the luminance values of one block of the backlight sought from the pixel group of the input image data of 2×2.

Further, it is configured to calculate the final 4K2K-size liquid crystal gradation data $V_{o1}, V_{o2}, \ldots, V_{o8}$ and so on by the liquid crystal gradation calculation circuit 55 based on the luminance value corresponding to each pixel position of the backlight luminance distribution data $V_{d1}, V_{d2}, \ldots, V_{d8}$ and so on, and the corresponding gradation value of each pixel of the 4K2K-size input image data $V_{i1}$ to $V_{i8}$ and so on.

Meanwhile, FIG. 13 is a block diagram illustrating a schematic configuration of a liquid crystal display device 100 which performs display by dividing an image disclosed in Patent Literature 1 into four areas of upper left, upper right, lower left and lower right.

As illustrated in FIG. 13, the liquid crystal display device 100 is provided with a control device 101, a liquid crystal display panel 102 and a backlight unit 103.

Further, the control device 101 is provided with a preprocessing circuit 110, dividing circuits 111*a* and 111*b*, upscaling circuits 112*a* to 112*d*, a down-converter 113, compensating circuits 114*a* to 114*d*, a liquid crystal driving circuit 115, a display map generating circuit 116, an LED resolution signal generating circuit 117, an luminance distribution data generating circuit 118, an LED driving circuit 119, and switches SW1 and SW2*a* to SW2*d*.

In such a circuit configuration, in a case where an image having a size larger than the image size that may be processed by the LED resolution signal generating circuit 117 is input, the compensating circuits 114*a* to 114*d* which calculate the gradation data to be output to the liquid crystal driving circuit 115 are capable of processing the image size that may be processed by the LED resolution signal generating circuit 117, and are configured to receive the input image divided by the dividing circuit 111*a* or the input image output from the dividing circuit 111*b* and processed by the upscaling circuits 112*a* to 112*d*, and the backlight luminance distribution data created by the luminance distribution data generating circuit 118.

Further, the backlight luminance distribution input to the compensating circuits 114*a* to 114*d* uses data from the common LED resolution signal generating circuit 117, and thus, it is possible to realize a high image quality using continuous emission distribution and the gradation data in accordance with the continuous emission distribution as compared to a simple multi-display.

CITATION LIST

Patent Literature

Patent Literature 1: International Publication "WO 2009/157221 (published on Dec. 30, 2009)"

SUMMARY OF INVENTION

Technical Problem

However, in the above-described circuit configuration of the related art as illustrated in FIGS. 11 and 12, it is necessary to provide the backlight luminance distribution estimation circuit 54, a memory circuit (not illustrated) for storing the 4K2K-size backlight luminance distribution data $V_{d1}, V_{d2}, \ldots, V_{d8}$ and so on calculated by the backlight luminance distribution estimation circuit 54, and the liquid crystal gradation calculation circuit 55 for calculating the 4K2K-size liquid crystal gradation data $V_{o1}, V_{o2}, \ldots, V_{o8}$ and so on from the backlight luminance distribution data $V_{d1}, V_{d2}, \ldots, V_{d8}$ and so on and the input image data $V_{i1}$ to $V_{i8}$ and so on.

Accordingly, in such a circuit configuration of the related art, there is a problem that the circuit size is increased and it takes a great deal of time for calculation. In particular, for the backlight luminance distribution data of the 4K2K size, it is necessary to superimpose the illumination distribution of one block in accordance with the luminance data of each backlight for the number of blocks by granularity of the 4K2K size, and it requires a great deal of calculation.

In addition, the liquid crystal display device 100 described in Patent Literature 1 has the following problem.

It is necessary to enlarge the luminance distribution data, output from the luminance distribution data generating circuit 118 illustrated in FIG. 13, to the image size to be input to the preprocessing circuit 110, and a storage area for holding data of the enlargement process and the enlarged data is required. In addition, it is necessary also for the compensating circuits 114*a* to 114*d* to calculate data to be output to the liquid crystal driving circuit 115 from both the data obtained from the luminance distribution data generating circuit 118 and the data obtained from the dividing circuit 111*a* or the upscaling circuits 112*a* to 112*d* so that a processing load or a circuit size is increased.

The present invention has been made in view of the above-described problems, and an object thereof is to provide a liquid crystal display device capable of processing an image having an unassumed image size, and further, reducing the storage area, the processing load and the circuit size.

Solution to Problem

To solve the above-described problems, a liquid crystal display device of the present invention includes: a local dimming control circuit configured to output first-size liquid crystal gradation data in accordance with first-size input image data, and output backlight luminance data; a liquid crystal panel; a backlight; at least one or more a down-converter configured to convert second-size image data, which is larger than the first-size image data, to the first-size image data; a luminance ratio calculation circuit configured to calculate a gradation ratio by dividing the first-size liquid crystal gradation data output from the local dimming control circuit by the first-size image data output from the down-converter, each of the data corresponding to the same position on a display face; and a gradation conversion circuit configured to calculate second-size liquid crystal gradation data by multiplying a plurality of data, which corresponds to neighboring positions on the display face and selected from the second-size image data in accordance with a reduction rate between the second-size image data and the first-size image data by the gradation ratio at the corresponding position on the display face.

Advantageous Effects of Invention

As described above, the liquid crystal display device of the present invention is configured to include: at least one or more a down-converter configured to convert second-size image data, which is larger than the first-size image data, to the first-size image data; a luminance ratio calculation circuit configured to calculate a gradation ratio by dividing the first-size liquid crystal gradation data output from the local dimming control circuit by the first-size image data output from the down-converter, each of the data corresponding to the same position on a display face; and a gradation conversion circuit configured to calculate second-size liquid crystal gradation data by multiplying a plurality of data, which corresponds to neighboring positions on the display face and selected from the second-size image data in accordance with a reduction rate between the second-size image data and the first-size image data by the gradation ratio at the corresponding position on the display face.

Therefore, it is possible to realize the liquid crystal display device that may process the image having the unassumed image size, and further, reduce the storage area, the processing load and the circuit size.

DESCRIPTION OF EMBODIMENTS

Hereinafter, embodiments of the present invention will be described in detail with reference to the drawings. However, dimensions, materials, shapes, relative arrangement or the like of components described in the embodiment are only an embodiment, and it should not be interpreted such that the scope of the invention is limited thereto.

Incidentally, in each embodiment hereinafter, a description will be made exemplifying a liquid crystal display device provided with a general LED backlight or the like, however, the present invention may be employed in, for example, a multicolor liquid crystal display device of a surface emitting type in which an ultraviolet light-emitting diode (such as an LED) is used as an excitation light source and a light-emitting position in a visually-recognizable color is not a backlight but a surface, or the like.

First Embodiment

Hereinafter, a liquid crystal display device 1 according to an embodiment of the present invention will be described with reference to FIGS. 1 to 5.

Figure 1:
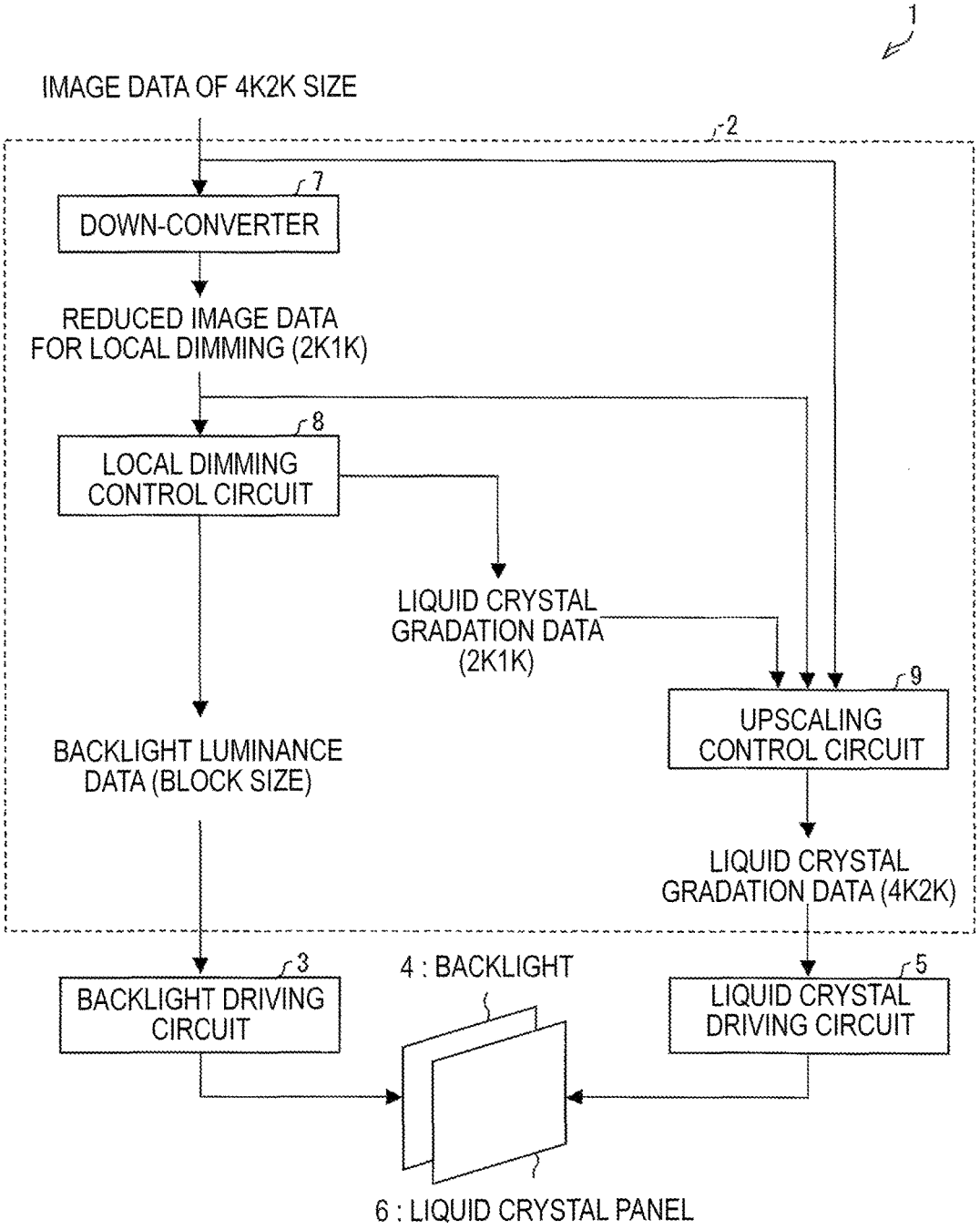
FIG. 1 is a block diagram of a liquid crystal display device according to an embodiment of the present invention.

FIG. 1 is a block diagram of the liquid crystal display device 1.

As illustrated in FIG. 1, the liquid crystal display device 1 is provided with a control section 2, a backlight driving circuit 3, a backlight 4, a liquid crystal driving circuit 5 and a liquid crystal panel 6.

Further, the control section 2 is provided with a down-converter 7, a local dimming control circuit 8 and an upscaling control circuit 9.

There are two types of sizes of image data handled in the control section 2 of the liquid crystal display device 1. One of them is a size that the local dimming control circuit 8 may process, and will be referred to as an LD size (Local Dimming size) in the description, and the description will be made exemplifying a 2K1K size as an example thereof. Specifically, a representative example is image data of 1920×1080.

Meanwhile, the control section 2 of the liquid crystal display device 1 is assumed to be capable of processing image data of a size larger than the LD size. The size larger than the LD size will be referred to as an I/O size (Input Output size) in the description, and the description will be made exemplifying a 4K2K size as an example thereof.

In the control section 2 of the liquid crystal display device 1 according to the present embodiment, which performs a local dimming process, in a case where the I/O size is larger than the LD size, it is possible to reduce a storage area such as a frame memory, a processing load and a circuit size compared to a configuration of the related art.

Hereinafter, the control section 2 of the liquid crystal display device 1 will be described.

An input image (image data of a 4K2K size) in the drawing is the image data to be input to the control section 2 of the liquid crystal display device 1. If a description is made for a case of a television, a main image engine such as a tuner is positioned in front of the control section 2, and the image data of the 4K2K size as the input image is output from the main image engine.

The image data of the 4K2K size output from the main image engine is input to the down-converter 7, and output as reduced image data for the local dimming having a 2K1K size that may be handled in the local dimming control circuit 8.

Further, the local dimming control circuit 8 is configured to increase a dynamic range of an output image by allowing luminance of the backlight 4 to be changed locally in accordance with content of the input image, for example, by lowering the luminance of the backlight 4 for a dark part in the image in a case of display in which a display device of a non-emitting type such as the liquid crystal panel 6 is applied with the luminance by the backlight 4 which is provided independently from the back surface of the liquid crystal panel being divided into several blocks capable of adjusting the luminance.

The local dimming control circuit 8 calculates luminance data of each block of the backlight 4 divided into the blocks based on the content of the image data when receiving the reduced image data for the local dimming having the 2K1K size (for example, a data size of 24×12 in a case where a division number is horizontally 24 divisions and vertically 12 divisions).

Then, the local dimming control circuit 8 superimposes illumination distribution of the backlight of one block, which is measured or estimated in advance, on the luminance data of each block, calculates gradation of each pixel of the liquid crystal panel 6 that the original input image may reproduce, and calculates liquid crystal gradation data of the 2K1K size.

The luminance data of each block output from the local dimming control circuit 8 is input to the backlight driving circuit 3 and causes lighting of the backlight 4.

Meanwhile, since the liquid crystal gradation data of the 2K1K size output from the local dimming control circuit 8 is not the 4K2K size which is the size to be finally displayed on the liquid crystal panel 6, the liquid crystal gradation data of the 2K1K size is input to the upscaling control circuit 9 in order to be enlarged into the 4K2K size.

The upscaling control circuit 9 calculates liquid crystal gradation data of the 4K2K size, which is the same size as the image data, based on three types of the image data, that is, the image data (the reduced image data for the local dimming having the 2K1K size and the liquid crystal gradation data of the 2K1K size) before and after the processing in the local dimming control circuit 8, and the initial input image data (the image data of the 4K2K size), and output the result to the liquid crystal driving circuit 5.

Further, the liquid crystal driving circuit 5 outputs the received liquid crystal gradation data of the 4K2K size to the liquid crystal panel 6. Incidentally, the lighting of the backlight 4 and the display of the liquid crystal panel 6 are configured such that the display is performed being synchronized therebetween for a frame by a synchronization circuit (not illustrated).

Figure 2:
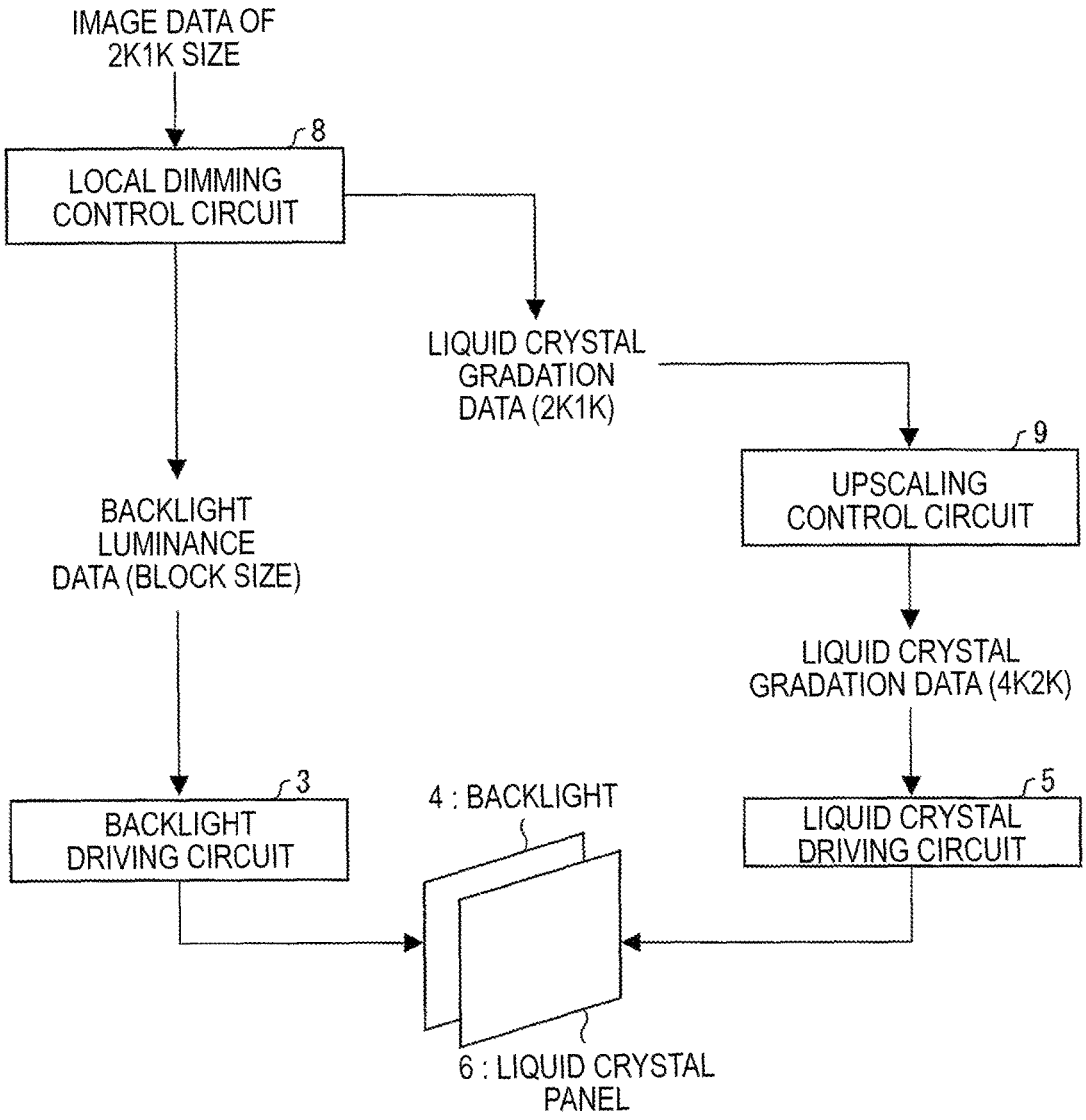
FIG. 2 is a block diagram illustrating a case where image data of a 2K1K size as a size that a local dimming control circuit may process is input to a control section of the liquid crystal display device according to the embodiment of the present invention illustrated in FIG. 1.

FIG. 2 is a block diagram illustrating a case where the image data of the 2K1K size as the size that the local dimming control circuit 8 may process is input to the control section 2 of the liquid crystal display device 1 illustrated in FIG. 1.

As illustrated in FIG. 2, in the case where the image data of the 2K1K size as the size that the local dimming control circuit 8 may process is input to the control section 2 of the liquid crystal display device 1, the image data of the 2K1K size is input to the local dimming control circuit 8 without the process in the down-converter 7.

The local dimming control circuit 8 first calculates the luminance data of each block of the backlight 4 divided into the blocks based on the content of the image data when receiving the image data of the 2K1K size.

Then, the local dimming control circuit 8 superimposes the illumination distribution of the backlight of one block, which is measured or estimated in advance, on the luminance data of each block, calculates the gradation of each pixel of the liquid crystal panel 6 in which the original input image may be reproduced, and calculates the liquid crystal gradation data of the 2K1K size.

Further, the liquid crystal gradation data of the 2K1K size is input to the upscaling control circuit 9, upscaled by horizontally and vertically doubling, and is output as the liquid crystal gradation data of the 4K2K size.

Figure 3:
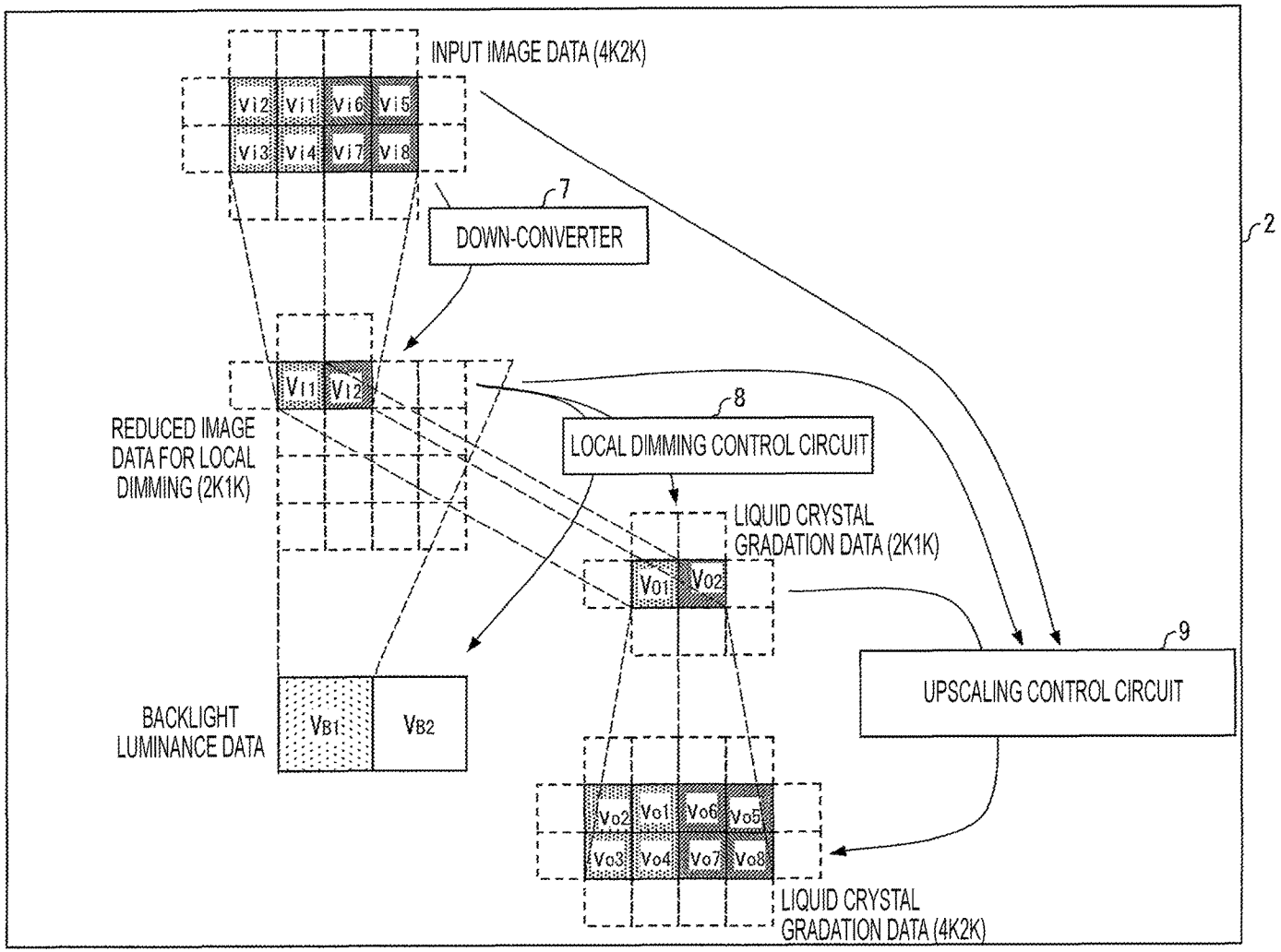
FIG. 3 is a diagram illustrating a process performed by the control section in a case where image data of a 4K2K size is input to the control section of the liquid crystal display device according to the embodiment of the present invention illustrated in FIG. 1.

FIG. 3 is a diagram illustrating a process performed by the control section 2 in a case where the image data of the 4K2K size is input to the control section 2 of the liquid crystal display device 1 illustrated in FIG. 1.

As illustrated in FIG. 3, first, the input image data of the 4K2K size is reduced into the reduced image data for the local dimming having the 2K1K size by the down-converter 7.

Any generally-known method of a nearest neighbor method, a linear interpolation method, quadratic interpolation, cubic interpolation, an average pixel method, and the like may be employed as a reduction method. The result obtained by reducing $V_{i1}$ to $V_{i4}$ among the image data of the 4K2K size by any one of the above-described methods is referred to as $V_{I1}$, and result obtained by reducing $V_{i5}$ to $V_{i8}$ among the image data of the 4K2K size by any one of the above-described methods is referred to as $V_{I2}$. Hereinafter, in the same manner, pixels of the aspect ratio 2×2 of the image having the 4K2K size are reduced thereby obtaining 2K1K-size reduced image data for the local dimming $V_{I1}$, $V_{I2}$, and so on.

Further, the 2K1K-size reduced image data for the local dimming $V_{I1}$, $V_{I2}$ and so on are processed by the local dimming control circuit 8 and backlight luminance data $V_{B1}$, $V_{B2}$, and so on, and 2K1K-size liquid crystal gradation data $V_{o1}$, $V_{o2}$ and so on are output. Incidentally, content of an internal process of the local dimming control circuit 8 will be described later.

The backlight luminance data of a block of the backlight, which is obtained from the reduced image data for the local dimming of a certain, for example, n×m size by the local dimming control circuit 8 is referred to as $V_{Bi}$. Meanwhile, 2K1K-size liquid crystal gradation data, which is obtained by the local dimming control circuit 8 in the same manner, corresponding to $V_{I1}$ is referred to as $V_{O1}$, and 2K1K-size liquid crystal gradation data corresponding to $V_{Ii}$ is referred to as $V_{oi}$, in general.

Then, when the 2K1K-size liquid crystal gradation data $V_{Oi}$ is obtained, the final 4K2K-size liquid crystal gradation data $V_{o(4\times i-3)}$, $V_{o(4\times i-2)}$, $V_{o(4\times i-1)}$ and $V_{o(4\times i)}$ may be obtained by Formulas (1) to (4) to be described below using the 2K1K-size liquid crystal gradation data $V_{Oi}$, the 2K1K-size reduced image for the local dimming $V_{Ii}$ and data of the 4K2K-size image data $V_{i(4\times i-3)}$, $V_{i(4\times i-2)}$, $V_{i(4\times i-1)}$ and $V_{i(4\times i)}$.

$$V_{o(4\times i-3)}=C\times V_{i(4\times i-3)} \quad \text{Formula (1)}$$

$$V_{o(4\times i-2)}=C\times V_{i(4\times i-2)} \quad \text{Formula (2)}$$

$$V_{o(4\times i-1)}=C\times V_{i(4\times i-1)} \quad \text{Formula (3)}$$

$$V_{o(4\times i)}=C\times V_{i(4\times i)} \quad \text{Formula (4)}$$

In the above-described Formulas (1) to (4), a gradation ratio $C=V_{Oi}/V_{I1}$.

As described above, in the control section 2 of the liquid crystal display device 1, the final 4K2K-size liquid crystal gradation data is obtained by a simple process.

When it is described with a specific example, in a case where $V_{i1}$, $V_{i2}$, $V_{i3}$ and $V_{i4}$ are respectively 128, 140, 116 and 136, for example, $V_{I1}$ becomes 130 by using an average thereof. Further, when the liquid crystal gradation data $V_{O1}$ to be output from the local dimming control circuit 8 at the time is 240, the 4K2K-size liquid crystal gradation data $V_{o1}$, $V_{o2}$, $V_{o3}$ and $V_{o4}$ to be output from the upscaling control circuit 9 are respectively as follows (a decimal is set to be rounded down, but a real number may be used).

$$V_{o1}=128\times240/130=236,$$

$$V_{o2}=140\times240/130=258,$$

$$V_{o3}=116\times240/130=214,$$

$$V_{o4}=136\times240/130=251,$$

The gradation ratio of each pixel at the time almost maintains a ratio of the input image data of the 4K2K size, and it may be confirmed that there is no problem in terms of accuracy from the following numbers.

$$V_{i2}/V_{i3}=140/116=1.2$$

$$V_{o2}/V_{o3}=258/214=1.2$$

Incidentally, in the above description, although it is confirmed that the gradation ratio of each pixel of the 4K2K-size liquid crystal gradation data almost maintains the ratio of the input image data of the 4K2K size by comparing only $V_{i2}/V_{i3}$ and $V_{o2}/V_{o3}$, the confirmation is possible by comparing, for example, $V_{i1}/V_{i2}$ and $V_{o1}/V_{o2}$.

Figure 4:
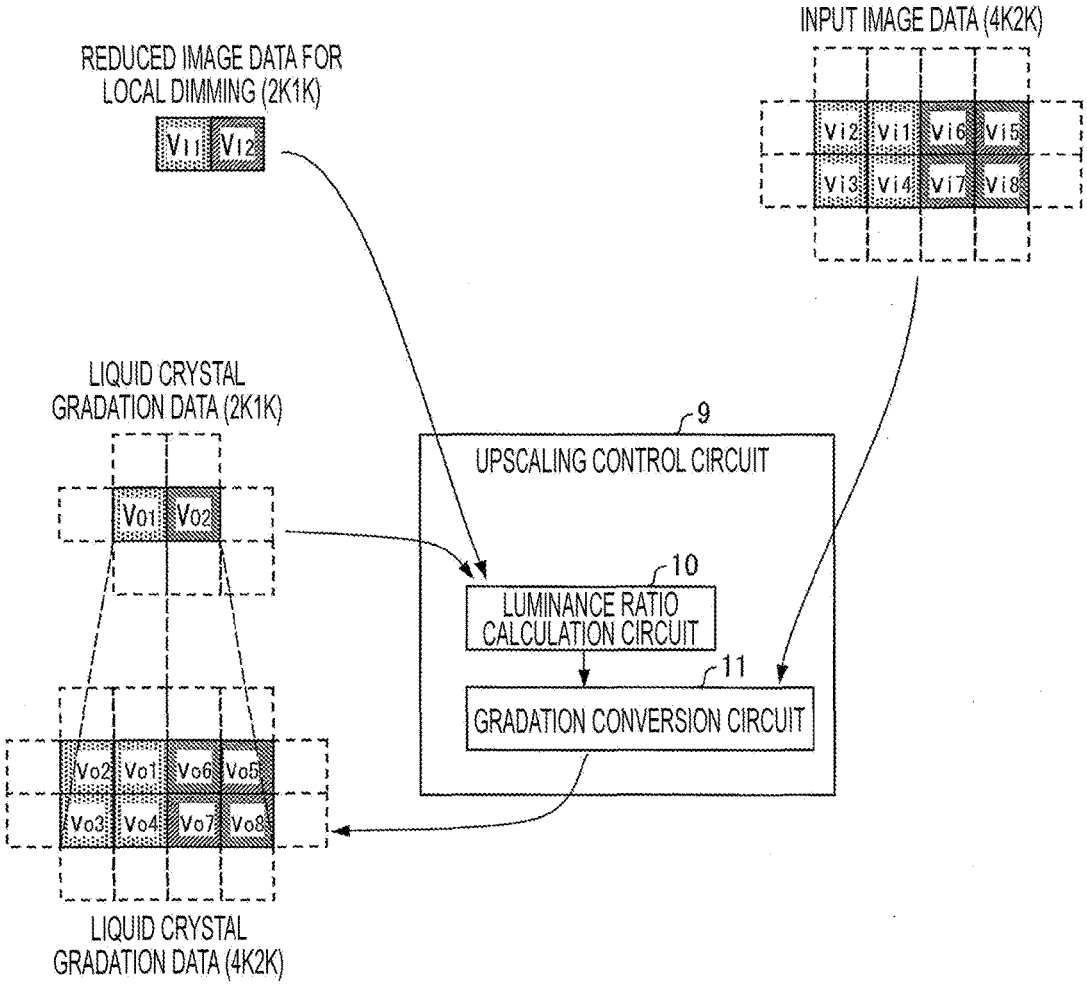
FIG. 4 is a diagram illustrating a process performed by an upscaling control circuit provided in the liquid crystal display device according to the embodiment of the present invention.

FIG. 4 is a diagram illustrating the process performed in the upscaling control circuit 9.

As illustrated in FIG. 4, the upscaling control circuit 9 is provided with a luminance ratio calculation circuit 10 and a gradation conversion circuit 11.

In the luminance ratio calculation circuit 10, it is possible to obtain the gradation ratio $C=V_{Oi}/V_{Ii}$ using the 2K1K-size reduced image for the local dimming $V_{Ii}$ and the 2K1K-size liquid crystal gradation data $V_{Oi}$.

Further, in the gradation conversion circuit 11, it is possible to obtain the 4K2K-size liquid crystal gradation data $V_{o1}$, $V_{o2}$ and so on using the gradation ratio C obtained by the luminance ratio calculation circuit 10 and the 4K2K-size input image data $V_{i1}$, $V_{i2}$ and so on.

Figure 5:
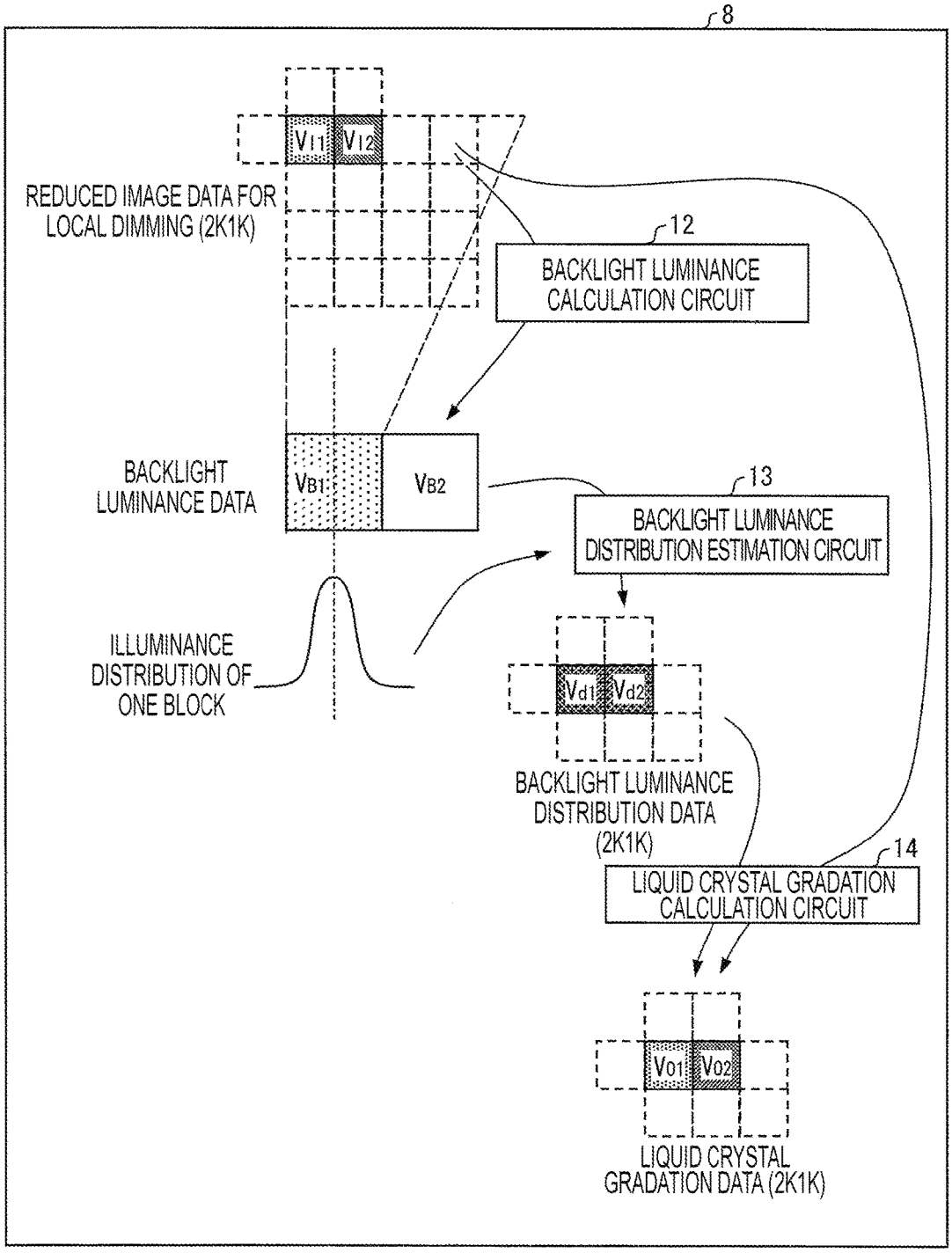
FIG. 5 is a diagram illustrating an internal process of the local dimming control circuit provided in the liquid crystal display device according to the embodiment of the present invention.

FIG. 5 is a diagram illustrating the internal process of the local dimming control circuit 8.

As illustrated in FIG. 5, the local dimming control circuit 8 is provided with a backlight luminance calculation circuit 12, a backlight luminance distribution estimation circuit 13 and a liquid crystal gradation calculation circuit 14.

The backlight 4 (illustrated in FIG. 1) is divided into blocks with lower resolution compared to resolution (the numbers of pixels) of the liquid crystal panel 6 (illustrated in FIG. 1), and a plurality of the pixels of the liquid crystal panel 6 corresponds to one block of the backlight 4. Accordingly, in the backlight luminance calculation circuit 12, the backlight luminance data $V_{B1}$, $V_{B2}$ and so on, as the luminance data of one block of the backlight 4, are determined by, for example, an average value, a maximum value or the like of a pixel group corresponding to the area.

The luminance data of one block of the backlight 4 obtained from the image data of a certain, for example, total n×m size having vertical n and horizontal m is referred to as $V_{Bi}$ (in the drawings, $V_{B1}$, $V_{B2}$ and the like).

Meanwhile, there are various calculation methods for the 2K1K-size liquid crystal gradation data, and for example, the 2K1K-size liquid crystal gradation data may be obtained by increasing or decreasing each pixel value of the image data input to the local dimming control circuit 8 in accordance with the average luminance value of the above-described backlight luminance data $V_{B1}$, $V_{B2}$ and so on (for example, if the average value is low, it becomes dark, and thus, the number of pixels is increased as the inverse number).

In the backlight luminance distribution estimation circuit 13 according to the present embodiment, the backlight luminance distribution data of the block size is superimposed on the illumination distribution of one block, which is determined in advance by measurement or estimation, and the backlight luminance distribution in which the image data is enlarged to have the resolution of 2K1K is obtained (in the drawings, $V_{d1}$, $V_{d2}$ and the like). Further, in the liquid crystal gradation calculation circuit 14, the 2K1K-size liquid crystal gradation data $V_{Oi}$ (in the drawings, $V_{o1}$, $V_{o2}$ and the like) is obtained by performing increase or decrease in accordance with the luminance value of a pixel unit (for example, each gradation value of the 2K1K-size reduced image data for the local dimming $V_{I1}$, $V_{I2}$ and so on are divided by each luminance value of the 2K1K-size backlight luminance distribution data $V_{d1}$, $V_{d2}$ and so on, or the gradation value of the liquid crystal panel 6 in association with the luminance value is stored in a look up table, and the gradation data is obtained from the association).

As described above, the control section 2 of the liquid crystal display device 1 according to the present embodiment is provided with the down-converter 7, local dimming control circuit 8 that may calculate the 2K1K-size liquid crystal gradation data $V_{Oi}$ from the 2K1K-size reduced image for the local dimming $V_{Ii}$, and the upscaling control circuit 9 which performs relatively simple calculation as illustrated in FIG. 4. Thus, it is possible to realize the liquid crystal display device 1 which may process an image having an unassumed image size (for example, the input image data of the 4K2K size), and further reduce the storage area, the processing load and the circuit size.

Figure 12:
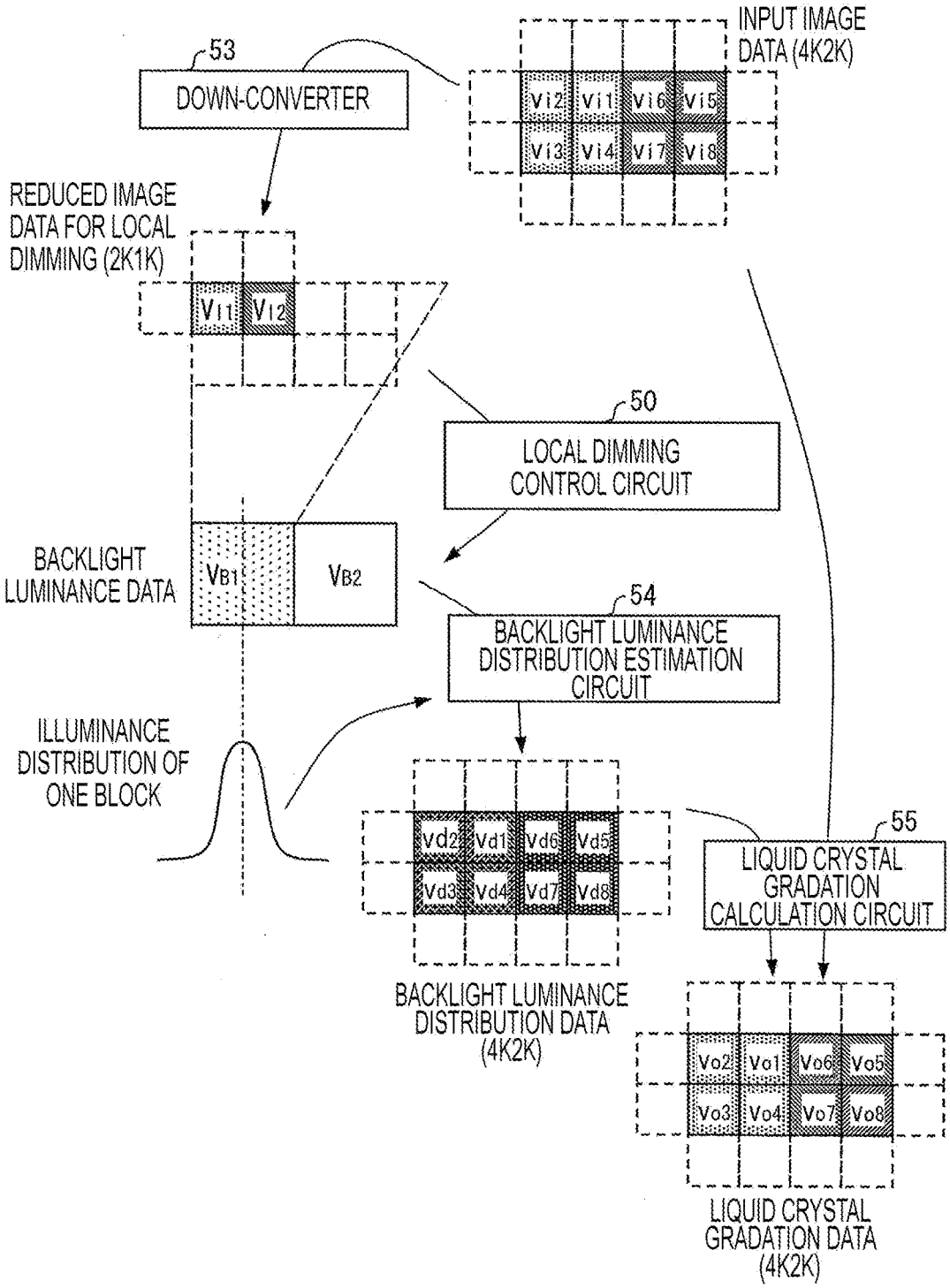
FIG. 12 is a diagram specifically illustrating a process performed by the local dimming control circuit, a down-converter, a backlight luminance distribution estimation circuit and a liquid crystal gradation calculation circuit illustrated in FIG. 11.

Meanwhile, in the configuration of the related art illustrated in FIG. 12, which has already been described in the above, it is necessary to provide a backlight luminance distribution estimation circuit 54 which calculates the 4K2K-size backlight luminance distribution data and a liquid crystal gradation calculation circuit 55 which calculates the 4K2K-size liquid crystal gradation data in addition to a local dimming control circuit 50 which has the same function as the local dimming control circuit 8 according to the present embodiment.

Accordingly, in the configuration of the related art illustrated in FIG. 12, it is necessary to provide the backlight luminance distribution estimation circuit 54, a memory circuit configured to store the 4K2K-size backlight luminance distribution data obtained by the backlight luminance distribution estimation circuit 54, and the liquid crystal gradation calculation circuit 55 configured to calculate the 4K2K-size liquid crystal gradation data, and accordingly, the circuit size thereof is increased and it takes a great deal of time for calculation as compared to the configuration provided to the control section 2 of the liquid crystal display device 1 according to the present embodiment.

In other words, in a case of a liquid crystal panel, as the configuration of the related art illustrated in FIG. 12, which has resolution equal to or greater than the 4K2K size and is configured such that it is necessary to obtain the backlight luminance distribution data having the same granularity in order to obtain the liquid crystal gradation data of the liquid crystal panel, the following calculation steps are required. However, a size of the granularity is set such that a granularity of a block<a granularity of the illumination distribution of one block<a granularity of the 4K2K size.

First, it is necessary to perform a superimposing step for the times of (the number of blocks of the backlight×the illumination distribution granularity of one block), a step of storing the superimposition result, and a step of calculating the liquid crystal gradation data for the times of the pixel numbers of the 4K2K size (dividing, referring to a table or the like).

Meanwhile, in the control section 2 of the liquid crystal display device 1 according to the present embodiment, the gradation ratio $C=V_{Oi}/V_{Ii}$ may be obtained from the 2K1K-size reduced image for the local dimming $V_{Ii}$ and the 2K1K-size liquid crystal gradation data $V_{Oi}$ in the luminance ratio calculation circuit 10, and the 4K2K-size liquid crystal gradation data $V_{o1}$ $V_{o2}$ and so on may be obtained from the gradation ratio C obtained by the luminance ratio calculation circuit 10 and the 4K2K-size input image data $V_{i1}$, $V_{i2}$ and so on, in the gradation conversion circuit 11.

As described above, in the configuration of the related art, in a case where an image size out of specification is input, backlight data having the same granularity as the final output gradation data in order to obtain the final output gradation data. However, in the liquid crystal display device 1 according to the present embodiment, only the original input data (the 4K2K-size input image data), data (the 2K1K-size reduced image data for the local dimming) reduced to a size of specification in order to be input to the local dimming control circuit, and the gradation data (the 2K1K-size liquid crystal gradation data) output from the local dimming control circuit are used, and the backlight luminance data is not used. Further, the final output gradation data (the 4K2K-size liquid crystal gradation data) is calculated from the data (the 2K1K-size reduced image data for the local dimming) input to the local dimming control circuit, and the original input data (the 4K2K-size input image data) multiplied by a ratio between the data input to the local dimming control circuit and the output gradation data (the 2K1K-size liquid crystal gradation data) at the same pixel position. Accordingly, it is possible to reduce the storage area, the processing load and the circuit size as compared to the related art, and further, it is possible to obtain the gradation ratio equal to or greater than that in the configuration of the related art.

In addition, a description will be made as follows by comparing the configuration of the related art illustrated in FIG. 13 and the liquid crystal display device 1 according to the present embodiment.

Figure 13:
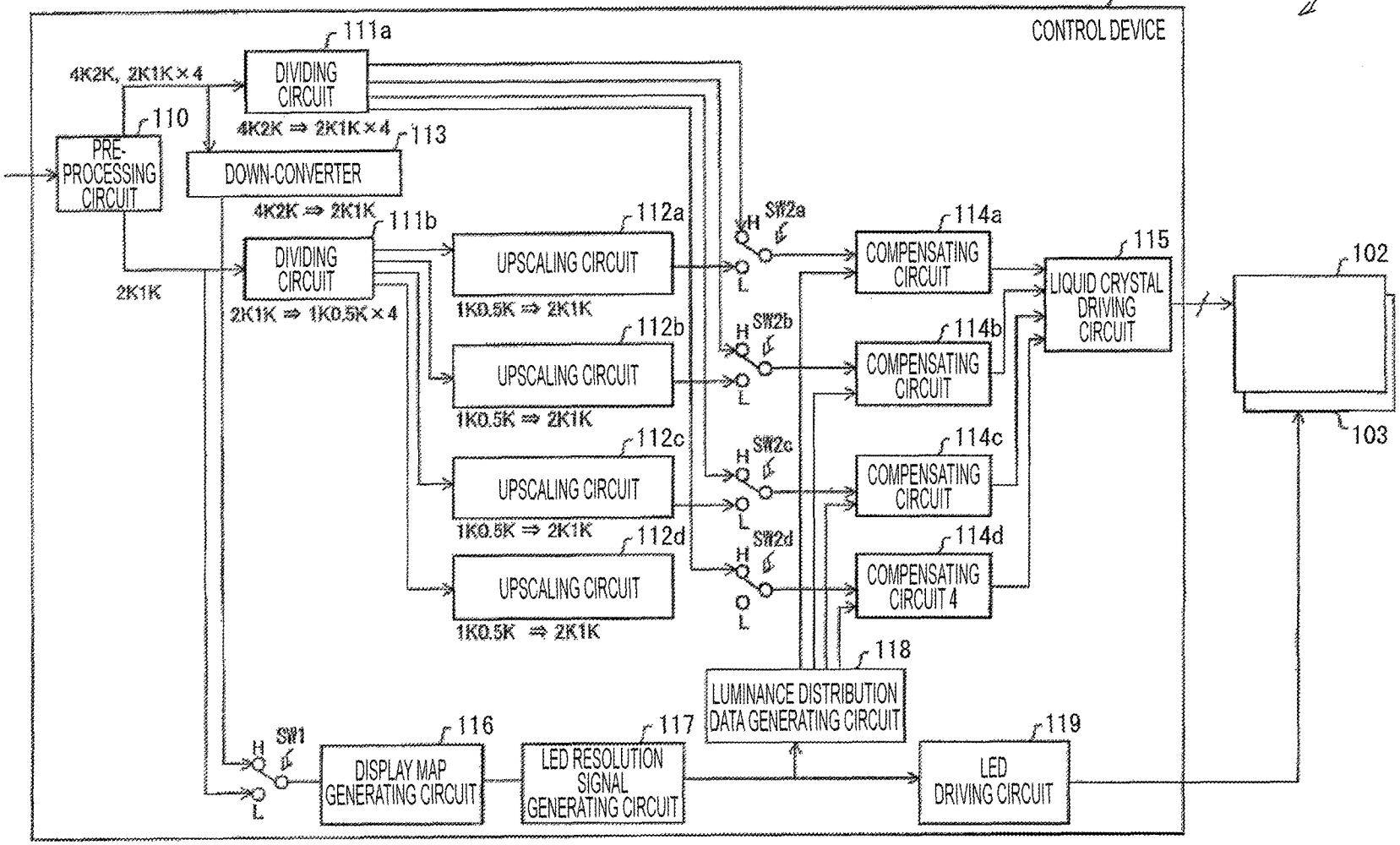
FIG. 13 is a block diagram illustrating a schematic configuration of the liquid crystal display device which performs display by dividing an image disclosed in Patent Literature 1 into four areas of upper left, upper right, lower left and lower right.

In the liquid crystal display device 1 according to the present embodiment, the data input to the liquid crystal driving circuit, which corresponds to a liquid crystal driving circuit 115 of the configuration of the related art illustrated in FIG. 13 is calculated from three types of data including the data (the 2K1K-size reduced image data for the local dimming) input to the local dimming control circuit, the liquid crystal gradation output data (the 2K1K-size liquid crystal gradation data) from the local dimming control circuit, and the original input image (the 4K2K-size input image data), and the first two data thereof may have an image size that may be processed by a circuit corresponding to an LED resolution signal generating circuit 117 of the configuration of the related art illustrated in FIG. 13. In addition, a circuit corresponding to a luminance distribution data generating circuit 118 of the configuration of the related art illustrated in FIG. 13 is included in the local dimming control circuit, but the output size thereof, which is used inside the local dimming control circuit, may be the image size that may be processed by the circuit corresponding to the LED resolution signal generating circuit 117. Due to such a configuration, in the liquid crystal display device 1 according to the present embodiment, there is no need to divide a part which corresponds to compensating circuits 114*a* to 114*d* of the configuration of the related art illustrated in FIG. 13 into four in terms of the image size, and a simple processing circuit may be employed. Accordingly, it is possible to reduce the storage area, the processing load and the circuit size.

Second Embodiment

Next, a second embodiment of the present invention will be described with reference to FIGS. 6 and 7. A liquid crystal display device 20 according to the present embodiment is equipped with a down-converter configured to convert the received input image of the 4K2K size to have the same resolution as the 2K1K-size liquid crystal gradation data to be output by the local dimming control circuit 8 in an upscaling control circuit 9*a*, which is different from the first embodiment described above. The other configuration is the same as described in the first embodiment. For convenience of the description, parts having the same function as parts illustrated in the drawings of the first embodiment described above will be denoted by the same reference sign and the description thereof will not be provided.

Figure 6:
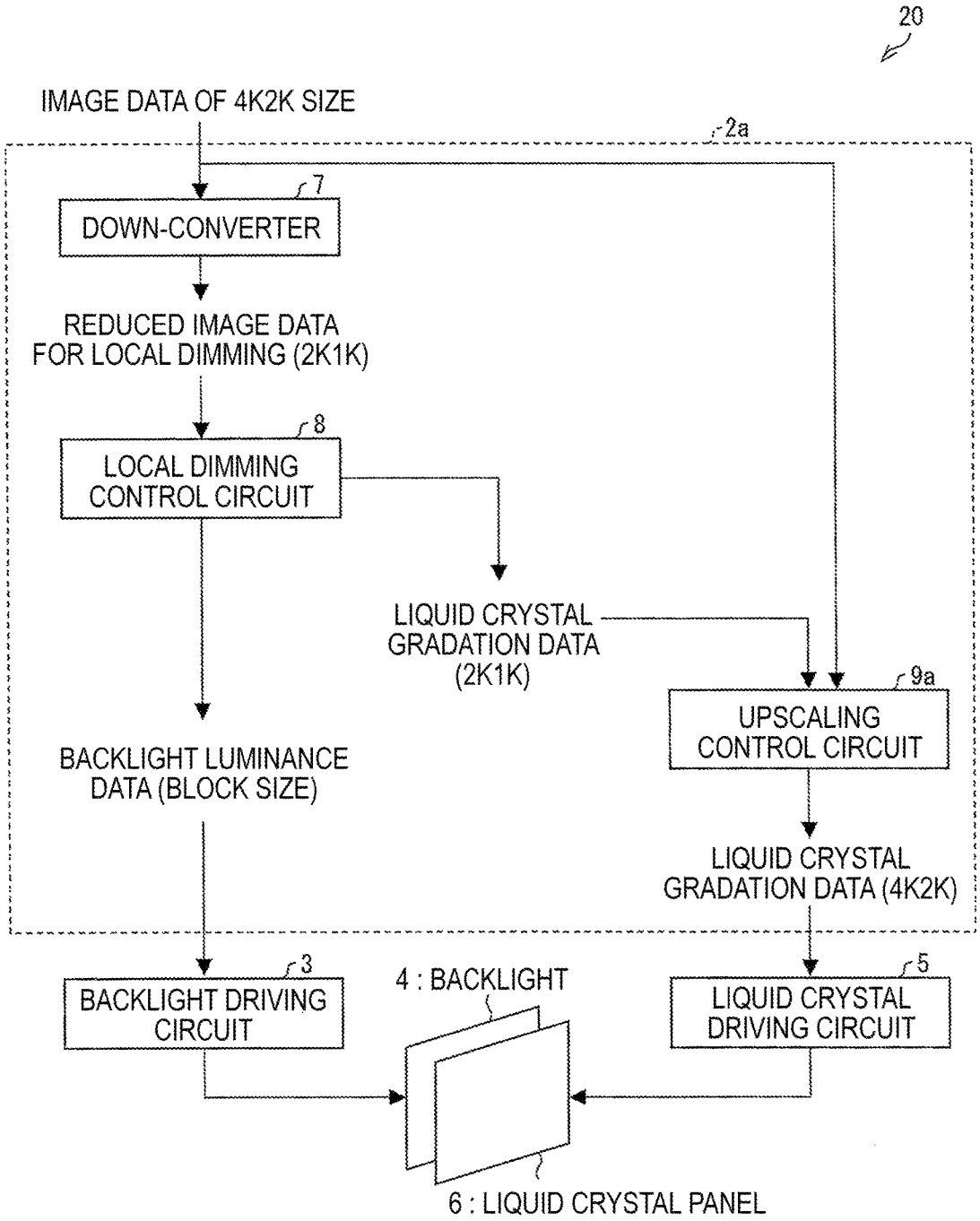
FIG. 6 is a block diagram of a liquid crystal display device according to another embodiment of the present invention.

FIG. 6 is a block diagram of the liquid crystal display device 20.

As illustrated in FIG. 6, the down-converter configured to convert the received input image of the 4K2K size to have the same resolution as the 2K1K-size liquid crystal gradation data to be output by the local dimming control circuit 8 is provided in the upscaling control circuit 9*a*, and there is no need to input the output from the down-converter 7. Thus, timing synchronization is not necessary and the configuration thereof becomes simple.

Figure 7:
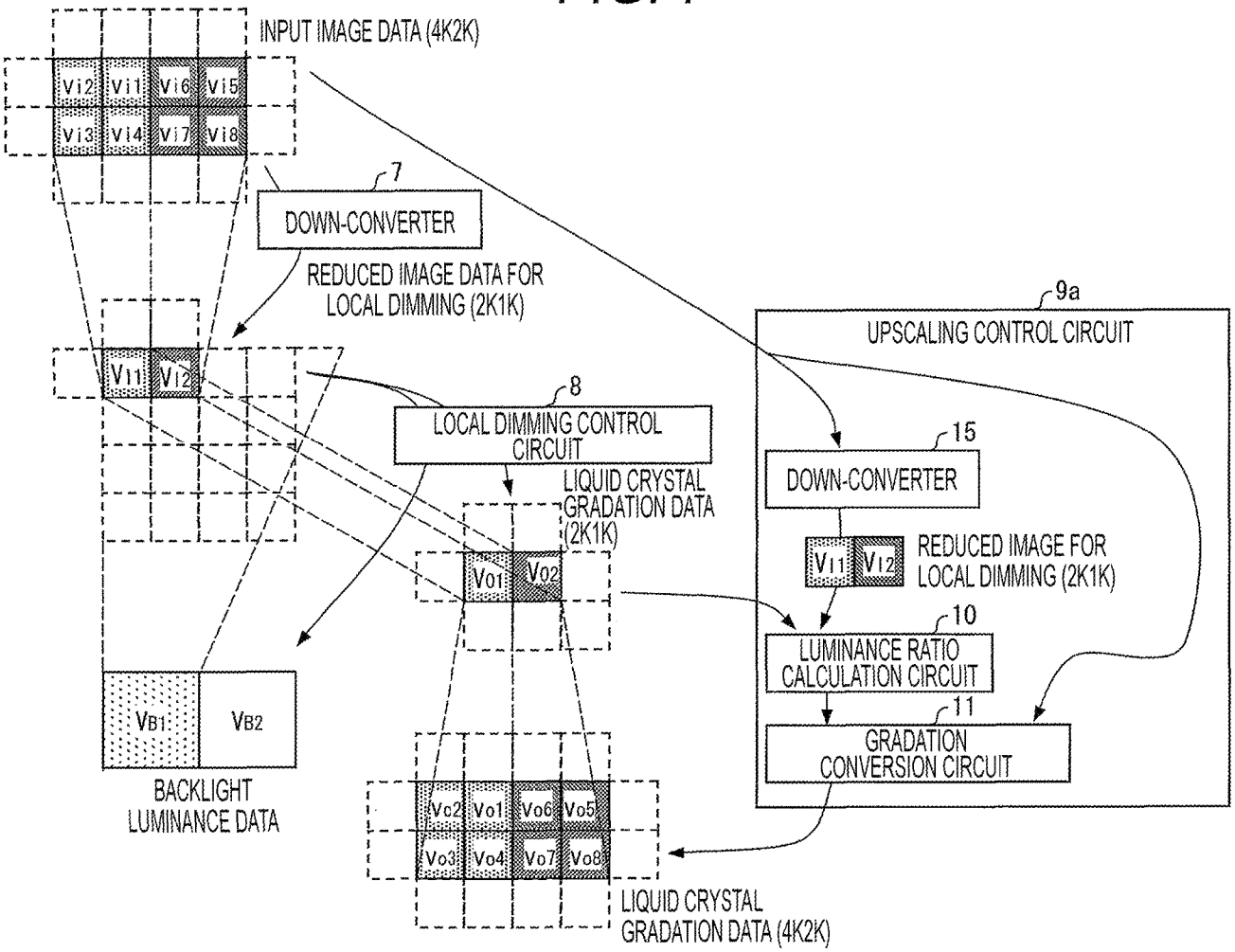
FIG. 7 is a diagram illustrating an inside of an upscaling circuit provided in the liquid crystal display device according to another embodiment of the present invention illustrated in FIG. 6.

FIG. 7 is a diagram illustrating an inside of the upscaling control circuit 9*a* illustrated in FIG. 6.

As illustrated in FIG. 7, only the 4K2K-size input image and the 2K1K-size liquid crystal gradation data output from the local dimming control circuit 8 are input to the upscaling control circuit 9*a*, different from FIG. 4 of the first embodiment, and the 2K1K-size reduced image for the local dimming to be input to the local dimming control circuit 8 is not needed to be input since the 2K1K-size reduced image for the local dimming may be generated using a down-converter 15 inside the upscaling control circuit 9*a*.

The 4K2K-size input image input to the upscaling control circuit 9*a* is branched inside the upscaling control circuit 9*a* and input also to the down-converter 15 and the 2K1K-size reduced image for the local dimming $V_{Ii}$, which is necessary for obtaining the gradation ratio C, is generated. Further, in the subsequent luminance ratio calculation circuit 10, the gradation ratio C is calculated from the 2K1K-size reduced image for the local dimming $V_{Ii}$ and the 2K1K-size liquid crystal gradation data received from the local dimming control circuit 8. Further, in the gradation conversion circuit 11, the final 4K2K-size liquid crystal gradation data is calculated from the calculated gradation ratio C and the original 4K2K-size input image, and is output.

Third Embodiment

Next, a third embodiment of the present invention will be described with reference to FIGS. 8 and 9. The liquid crystal display device 30 according to the present embodiment is provided with the luminance ratio calculation circuit 10 outside an upscaling control circuit 9*b*, which is different from the first embodiment described above. The other configuration is the same as described in the first embodiment. For convenience of the description, parts having the same function as the parts illustrated in the drawings of the first embodiment described above will be denoted by the same reference numeral and the description thereof will not be provided.

Figure 8:
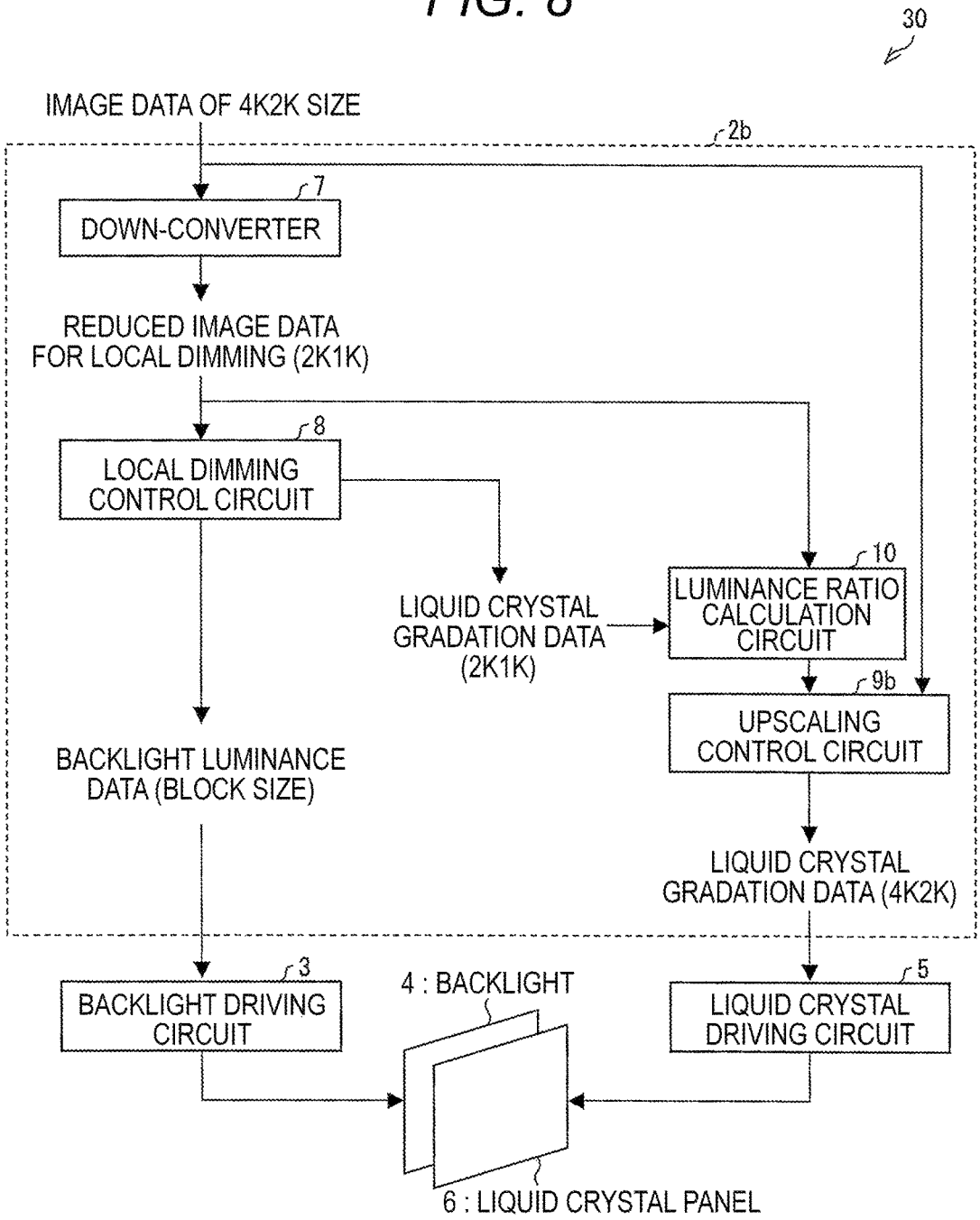
FIG. 8 is a block diagram of a liquid crystal display device according to further another embodiment of the present invention.

FIG. 8 is a block diagram of a liquid crystal display device 30.

As illustrated in FIG. 8, it is configured such that the luminance ratio calculation circuit 10, configured to calculate the gradation ratio C from the 2K1K-size reduced image for the local dimming $V_{Li}$ output from the down-converter 7 and the 2K1K-size liquid crystal gradation data output from the local dimming control circuit 8, is provided outside the upscaling control circuit 9*b*.

According to such a configuration, it is possible to form the simpler upscaling control circuit 9*b*, and further, a degree of freedom increases in selecting the arrangement position of the luminance ratio calculation circuit 10.

Figure 9:
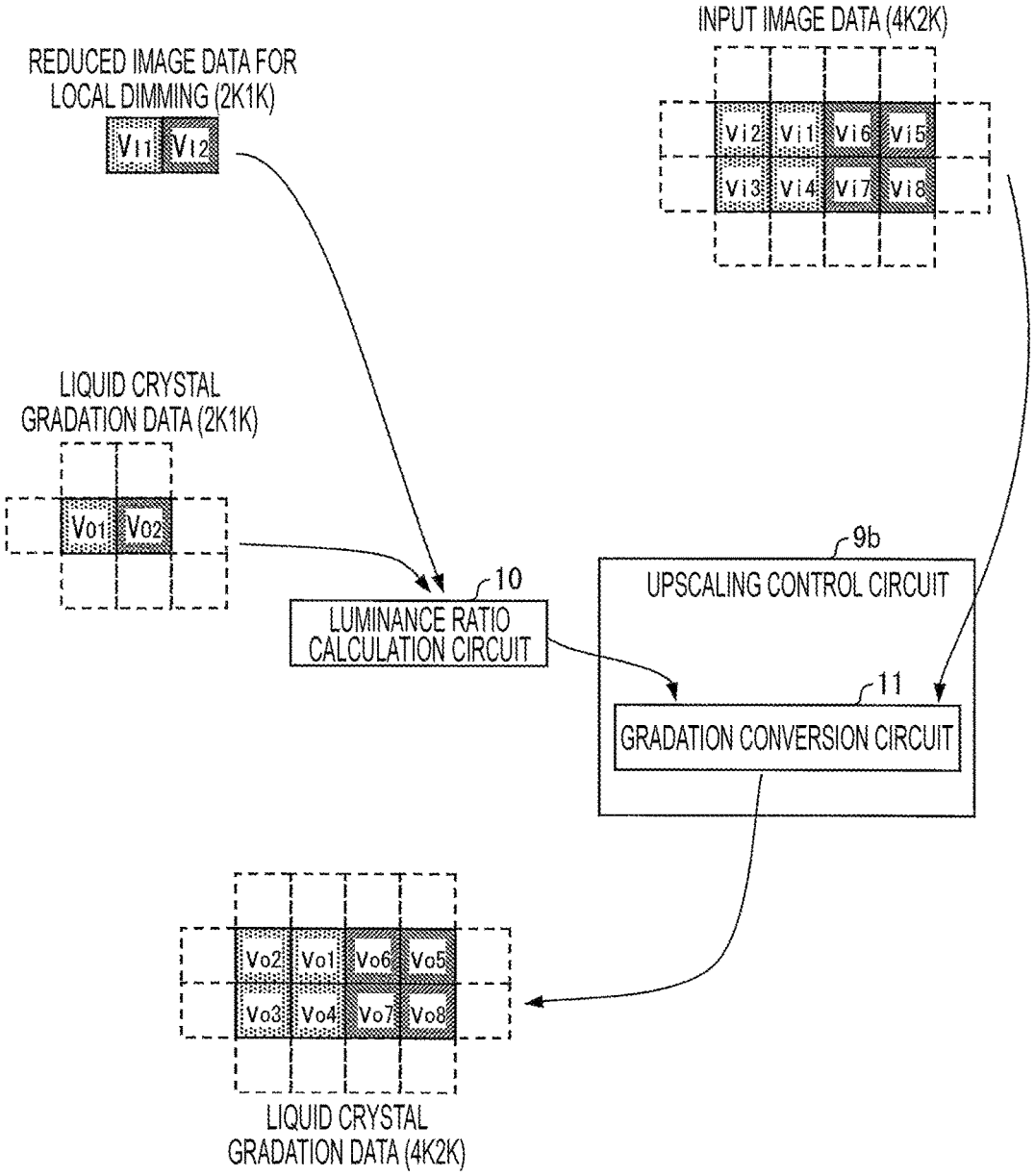
FIG. 9 is a diagram illustrating an inside of an upscaling circuit provided in the liquid crystal display device according to further another embodiment of the present invention illustrated in FIG. 8.
Figure 10:
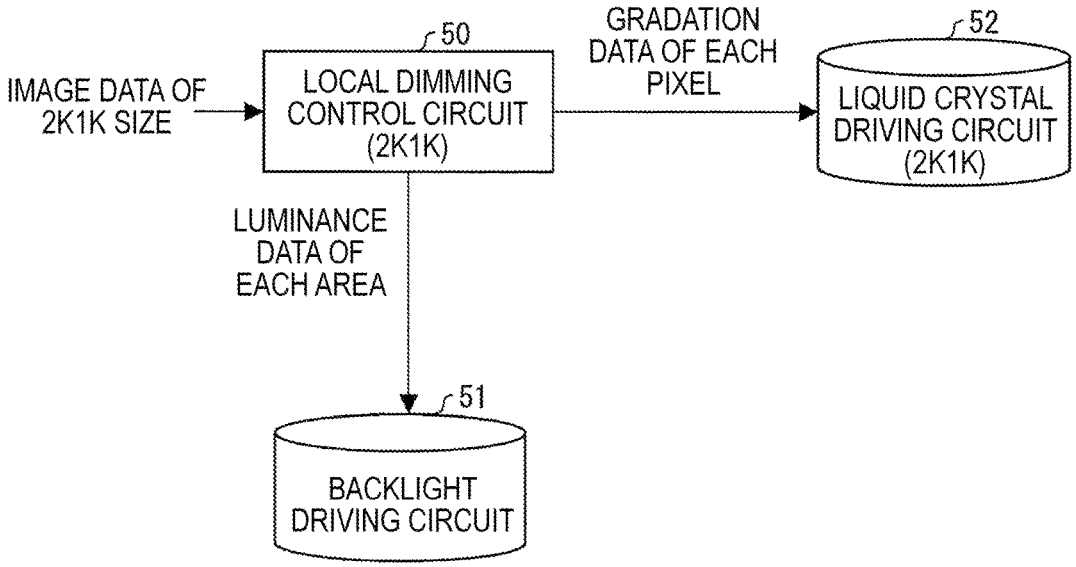
FIG. 10 is a diagram illustrating a function of the local dimming control circuit provided in the liquid crystal display device.
Figure 11:
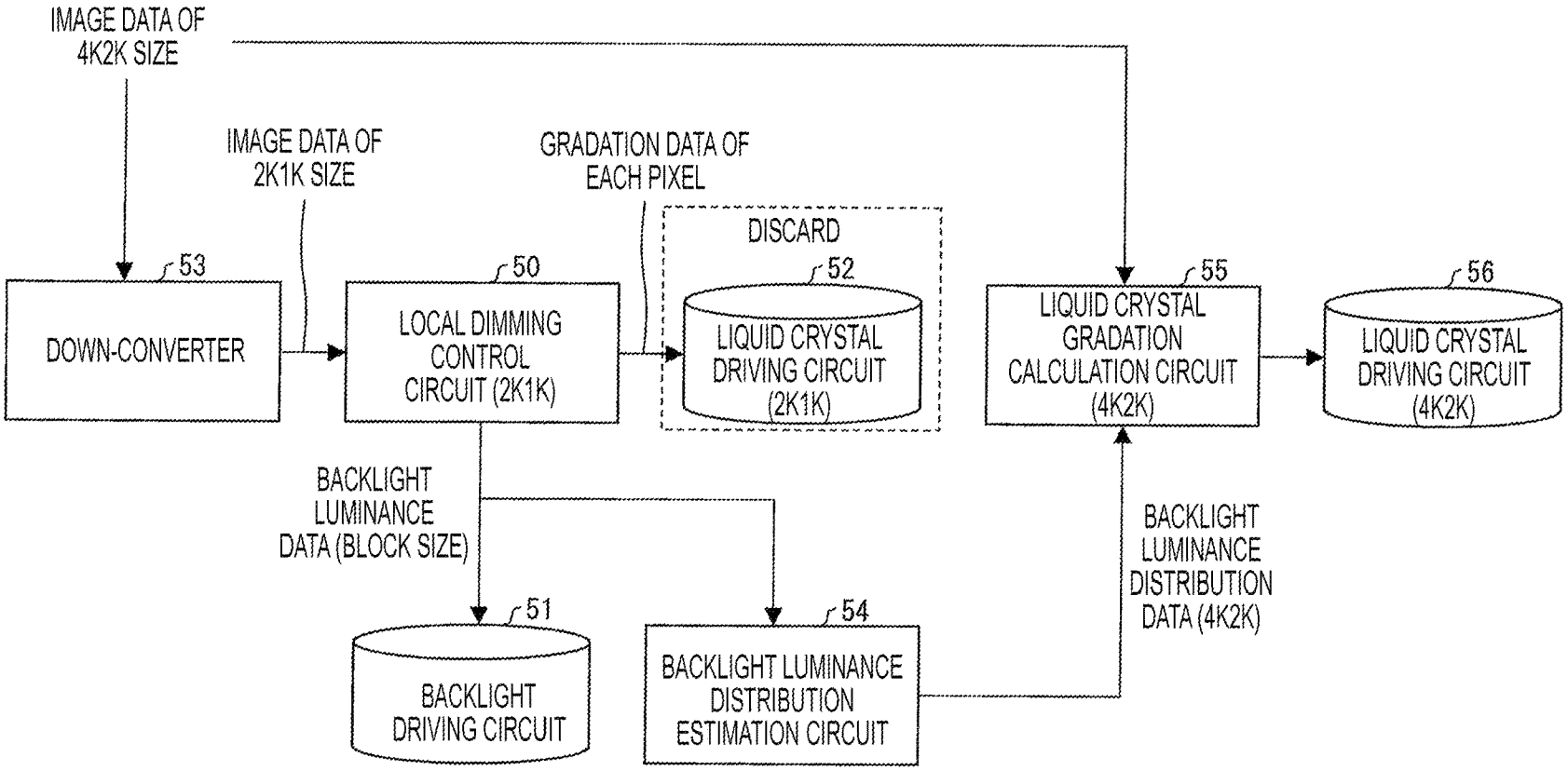
FIG. 11 is a diagram illustrating a circuit configuration of the related art provided with a local dimming control circuit which may process UHD image data (the image data of the 4K2K size) as an image size that is not assumed and in which an image size that may be processed is fixed to a 2K1K size.

FIG. 9 is a diagram illustrating an inside of the upscaling control circuit 9*b* illustrated in FIG. 8.

As illustrated in FIG. 9, the 4K2K-size input image and the gradation ratio C output from the luminance ratio calculation circuit 10 are only input to the upscaling control circuit 9*b*, different from FIG. 4 of the first embodiment.

Further, in the gradation conversion circuit 11 provided in the upscaling control circuit 9*b*, the final 4K2K-size liquid crystal gradation data is calculated from the gradation ratio C and the original 4K2K-size input image, and is output.

The present invention is not limited to each embodiment described above, and various modifications may be possible in the scope described in the claim. Further, an embodiment obtained by appropriately combining technical means disclosed, respectively, in the different embodiments may be included in the technical scope of the present invention.

SUMMARY

A liquid crystal display device according to a first aspect of the present invention is a liquid crystal display device including: a local dimming control circuit configured to output first-size liquid crystal gradation data in accordance with first-size input image data, and output backlight luminance data; a liquid crystal panel; a backlight; at least one or more a down-converter configured to convert second-size image data, which is larger than the first-size image data, to the first-size image data; a luminance ratio calculation circuit configured to calculate a gradation ratio by dividing the first-size liquid crystal gradation data output from the local dimming control circuit by the first-size image data output from the down-converter, each of the data corresponding to the same position on a display face; and a gradation conversion circuit configured to calculate second-size liquid crystal gradation data by multiplying a plurality of data, which corresponds to neighboring positions on the display face and selected from the second-size image data in accordance with a reduction rate between the second-size image data and the first-size image data by the gradation ratio at the corresponding position on the display face.

According to the configuration described above, since the local dimming control circuit configured to calculate the first-size liquid crystal gradation data from the first-size image data which is smaller than the second-size image data, and the luminance ratio calculation circuit and the gradation conversion circuit configured to perform relatively simple calculation are provided, it is possible to realize the liquid crystal display device capable of processing an image having an image size that is not assumed, and further, reducing the storage area, the processing load and the circuit size.

The liquid crystal display device according to a second aspect of the present invention may be configured such that the number of the down-converter is one, and the first-size image data output from the down-converter is supplied to the local dimming control circuit and the luminance ratio calculation circuit.

According to the configuration described above, it is possible to use only one down-converter.

The liquid crystal display device according to a third aspect of the present invention may be configured such that the down-converter includes a first down-converter and a second down-converter, and the first-size image data output from the first down-converter is supplied to the local dimming control circuit and the first-size image data output from the second down-converter is supplied to the luminance ratio calculation circuit.

According to the configuration described above, it is possible to supply the first-size image data to the local dimming control circuit and the luminance ratio calculation circuit via the down-converters different from one another.

The liquid crystal display device according to a fourth aspect of the present invention may be configured such that the luminance ratio calculation circuit and the gradation conversion circuit are provided in an upscaling control circuit.

According to the configuration described above, it is possible to provide the upscaling control circuit with a relatively simple configuration.

The liquid crystal display device according to a fifth aspect of the present invention may be configured such that the luminance ratio calculation circuit, the gradation conversion circuit and the second down-converter are provided in an upscaling control circuit.

According to the configuration described above, since the upscaling control circuit also includes the second down-converter and there is no need to input the output from the first down-converter to the upscaling control circuit, the timing synchronization is not necessary so that it is possible to provide a simpler configuration.

The liquid crystal display device according to a sixth aspect of the present invention may be configured such that the upscaling control circuit includes the gradation conversion circuit.

According to the configuration described above, it is possible to provide the upscaling control circuit with further simple configuration, and the degree of freedom increases in selecting the arrangement position of the luminance ratio calculation circuit as compared to a case where the luminance ratio calculation circuit is provided in the upscaling control circuit.

INDUSTRIAL APPLICABILITY

The present invention may be employed to a liquid crystal display device.

REFERENCE SIGNS LIST

1 liquid crystal display device
2 control section
2*a* control section
2*b* control section
3 backlight driving circuit
4 backlight
5 liquid crystal driving circuit
6 liquid crystal panel
7 down-converter
8 local dimming control circuit
9 upscaling control circuit
9*a* upscaling control circuit
9*b* upscaling control circuit
10 luminance ratio calculation circuit
11 gradation conversion circuit
12 backlight luminance calculation circuit
13 backlight luminance distribution estimation circuit
14 liquid crystal gradation calculation circuit
15 down-converter (second down-converter)
20 liquid crystal display device
30 liquid crystal display device

The invention claimed is:

1. A liquid crystal display device comprising:

a local dimming control circuit that outputs backlight luminance data in accordance with first-size input image data, and outputs first-size liquid crystal gradation data such that the first-size input image data is reproduced by superimposing the backlight luminance data on the first-size liquid crystal gradation data;

a liquid crystal panel;

a backlight in which a luminance of each region of a plurality of backlight regions is controlled in accordance with the backlight luminance data;

at least one or more down-converters that convert second-size image data, which is larger than the first-size image data, to the first-size image data;

a luminance ratio calculation circuit that calculates a gradation ratio by dividing the first-size liquid crystal gradation data output from the local dimming control circuit by the first-size image data output from the down-converter, each of the data corresponding to a same position on a display face; and a gradation conversion circuit that calculates second-size liquid crystal gradation data by multiplying a plurality of data, which corresponds to neighboring positions on the display face and selected from the second-size image data in accordance with a reduction rate between the second-size image data and the first-size image data by the gradation ratio at a corresponding position on the display face, wherein the at least one or more down-converters includes a first down-converter and a second down-converter, the first-size image data output from the first down-converter is supplied to the local dimming control circuit and the first-size image data output from the second down-converter is supplied to the luminance ratio calculation circuit, the luminance ratio calculation circuit and the gradation conversion circuit are provided in an upscaling control circuit.

2. The liquid crystal display device according to claim 1, wherein a number of the at least one or more down-converters is one, and the first-size image data output from the down-converter is supplied to the local dimming control circuit and the luminance ratio calculation circuit.

3. The liquid crystal display device according to claim 1, wherein the luminance ratio calculation circuit, the gradation conversion circuit and the second down-converter are provided in an upscaling control circuit.

4. The liquid crystal display device according to claim 1, wherein the gradation conversion circuit is provided in an upscaling control circuit.

* * * * *